US006805346B2

(12) United States Patent
Stemmle

(10) Patent No.: US 6,805,346 B2
(45) Date of Patent: Oct. 19, 2004

(54) BOTTOM STACKING APPARATUS FOR STACKING MAILPIECES

(75) Inventor: Denis J. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/065,287

(22) Filed: Sep. 30, 2002

(65) Prior Publication Data

US 2004/0061281 A1 Apr. 1, 2004

(51) Int. Cl.[7] ..... B65H 29/40
(52) U.S. Cl. ..... 271/178; 271/192; 271/212
(58) Field of Search ..... 271/178, 192, 271/212

(56) References Cited

U.S. PATENT DOCUMENTS 3,092,381 A * 6/1963 Schick ..... 271/180
3,861,537 A * 1/1975 Duchinsky et al. ..... 414/788.3
4,335,987 A * 6/1982 Laxo ..... 414/27
4,378,938 A * 4/1983 Staniszewski ..... 271/179
4,997,337 A 3/1991 Trimble
5,544,876 A * 8/1996 Ruch ..... 271/179
5,709,525 A 1/1998 Marzullo et al.

* cited by examiner

*Primary Examiner*—Donald P. Walsh
*Assistant Examiner*—Kenneth W Bower
(74) *Attorney, Agent, or Firm*—Michael J. Cummings; Charles R. Malandra, Jr.; Angelo N. Chaclas

(57) ABSTRACT

An embodiment of the present invention comprises a apparatus for stacking mailpieces comprising elongated intermittently rotating S-elements, one of the rotating S-elements has an S-shaped cross section, the other of the rotating S-elements has a mirror image of the S-shape cross section. In the preferred embodiment, a new mailpiece to be stacked enters the stacker below the top curve of the rotating S-shaped elements, and above the shelf-like center portion of the S-shaped elements. The imaged portion of the mailpiece (i.e. the top side) does not contact the stack or the S-shaped elements while being moved into the stacker. The likelihood of smearing is greatly reduced. Once the new mailpiece is moved into the area below the stack and between the two rotating S-shaped elements, the two elements are rotated. This action lifts the new mailpiece upward directly into contact with the bottom of the stack, thus lifting the entire stack by the thickness of the new mailpiece. Additionally, the weight of the stack is felt by the new mailpiece when it is in place in the stack; this improves sealing.

8 Claims, 6 Drawing Sheets

BOTTOM STACKING APPARATUS FOR STACKING MAILPIECES

BACKGROUND OF INVENTION

Field of the Invention

The invention disclosed herein relates generally to the field of paper handling preparation and more particularly, to a stacking apparatus.

Background of the Invention

Mailpiece stacking devices are known for taking singulated items and forming them into stacks or columns. Stackers are commonly used in conjunction with photocopier machines, printers, facsimile machines, mailing machines, folders, folder/sealers, small envelope inserting devices, mail openers, envelope printers and labelers. In many of these applications, such as mailing machines and envelope printers, an envelope is imprinted with an address and then immediately fed into a stacker. The ink on the envelope is often not dry as the mailpiece enters the stacker. Failure of the ink to dry enables a successive envelope to smear the ink on a previous envelope in the stacker.

In order to obtain the postal rate discounts, the order of the mailpieces that have been presorted and processed by the mail-processing machine in consecutive order needs to be maintained. The removed stack of mailpieces can be manually placed in a mail tray that is sent to the postal service. In this manner, the user can take advantage of lower postal rates that are provided to users who tray envelopes according to predetermined criteria. The predetermined criteria includes the maintaining of mailpieces in the exact order in which they were processed in the mail processing machine. Generally, the predetermined criteria relates to a reduction in the postal service's handling of the mail from the mailers. The United States Postal Service ("USPS") offers several levels of discounts to mailers. The level of discount typically is based on the number of criteria met by the mailer. For example, in order to maximize such postage discounts, the USPS requires that high volume mailers presort the mailpieces, apply a ZIP+4 bar code to each mailpiece, and package their mail into trays with each tray tagged in accordance with the Domestic Mail Manual.

The instant invention relates to a method and apparatus for stacking documents, and more particularly to a stacking machine for stacking filled envelopes that may carry ink that has not completely dried on their surfaces. In addition, the method and apparatus help to maintain the order of the mailpieces so that they can conform to a predefined discount criteria that was considered when the mailpieces were being prepared (i.e., addressed, inserted).

Thus, one of the problems of the prior art is that a ink from an envelope can smear onto an adjacent envelope. Another problem of the prior art is degradation of printed images and transference of ink. Another problem is that it is desirable to maintain the order of the mailpieces being stacked. Therefore, a system and method for stacking envelopes is needed which provides decreased smearing and maintains mailpiece order.

SUMMARY OF INVENTION

This invention overcomes the disadvantages of the prior art by providing an apparatus for stacking mailpieces. A stack of mail pieces rests on top of two elongated intermittently rotating S-elements, one of the rotating S-elements has an S-shaped cross section, the other of the rotating S-elements has a mirror image of the S-shape cross section. In the preferred embodiment,a new mailpiece to be stacked enters the stacker below the top curve of the S-shaped elements, and above the shelf-like center portion of the S-shaped elements. The imaged portion of the mailpiece (i.e., the top side) does not contact either the stack or the upper curved portion of the S-shaped elements while being moved into the stacker. Thus, the likelihood of smearing is greatly reduced. Once the new mailpiece is moved into the area below the stack and between the two rotating S-shaped elements, the two elements are rotated 180 degrees. This action lifts the new mailpiece upward directly into contact with the bottom of the stack, thus lifting the entire stack by the thickness of the new mailpiece. Once again, during this lifting action, sliding motion does not occur or is minimized between the top side of the mail piece and the stack or the rotating elements. Smearing of the images such as address and indicia images is minimized or does not occur. Additionally, the weight of the stack is felt by the new mailpiece when it is in place in the stack; this improves sealing.

An advantage of the present invention is that it decreases image smearing, reduces stacker footprint, improves sealing, and provides ordered stacking (i.e., stacks in 1 to N order) which simplifies software requirements especially relating to jam recovery algorithms. For copiers and printers where page sequence is printed in forward order (1 to N) the pages or mailpieces can be stacked in correct order in the face up bottom stacker of the present invention. The apparatus also enables simple stack unloading while running. The stack unloading requires decreased operator skill. The apparatus is also cost effective. Other advantages of the invention will in part be obvious and will in part be apparent from the specification. The aforementioned advantages are illustrative of the advantages of the present invention.

BRIEF DESCRIPTION OF DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION

Figure 1:
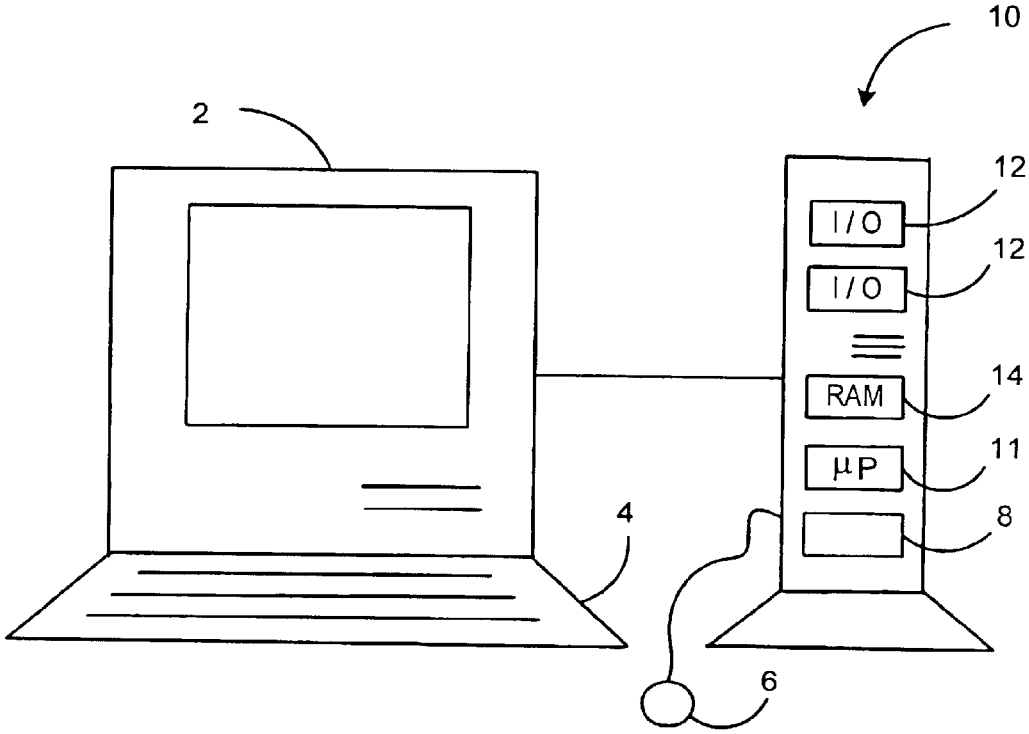
FIG. 1 is a block diagram that illustrates a computer system 100, the use of which an embodiment of the invention may be implemented.

In describing the present invention, reference will be made herein to FIGS. 1–6 of the drawings in which like numerals refer to like features of the invention. Features of the invention are not necessarily shown to scale in the drawings.

Control Overview

FIG. 1 is a block diagram that illustrates a computer system 10, the use of which an embodiment of the invention may be implemented. Computer system 10 may be a personal computer which is used generically and refers to present and future microprocessing systems with at least one processor operatively coupled to at least one user interface means, such as a display 2 and keyboard 4, and/or a cursor control, such as a mouse or a trackball 6, and storage media 8. The personal computer 10 may be a workstation that is accessible by more than one user. The personal computer also includes a conventional processor 11, such as a Pentium® microprocessor manufactured by Intel, and conventional memory devices such as hard drive 8, floppy or CDRW drive(s) 12, and memory 14.

Figure 2:
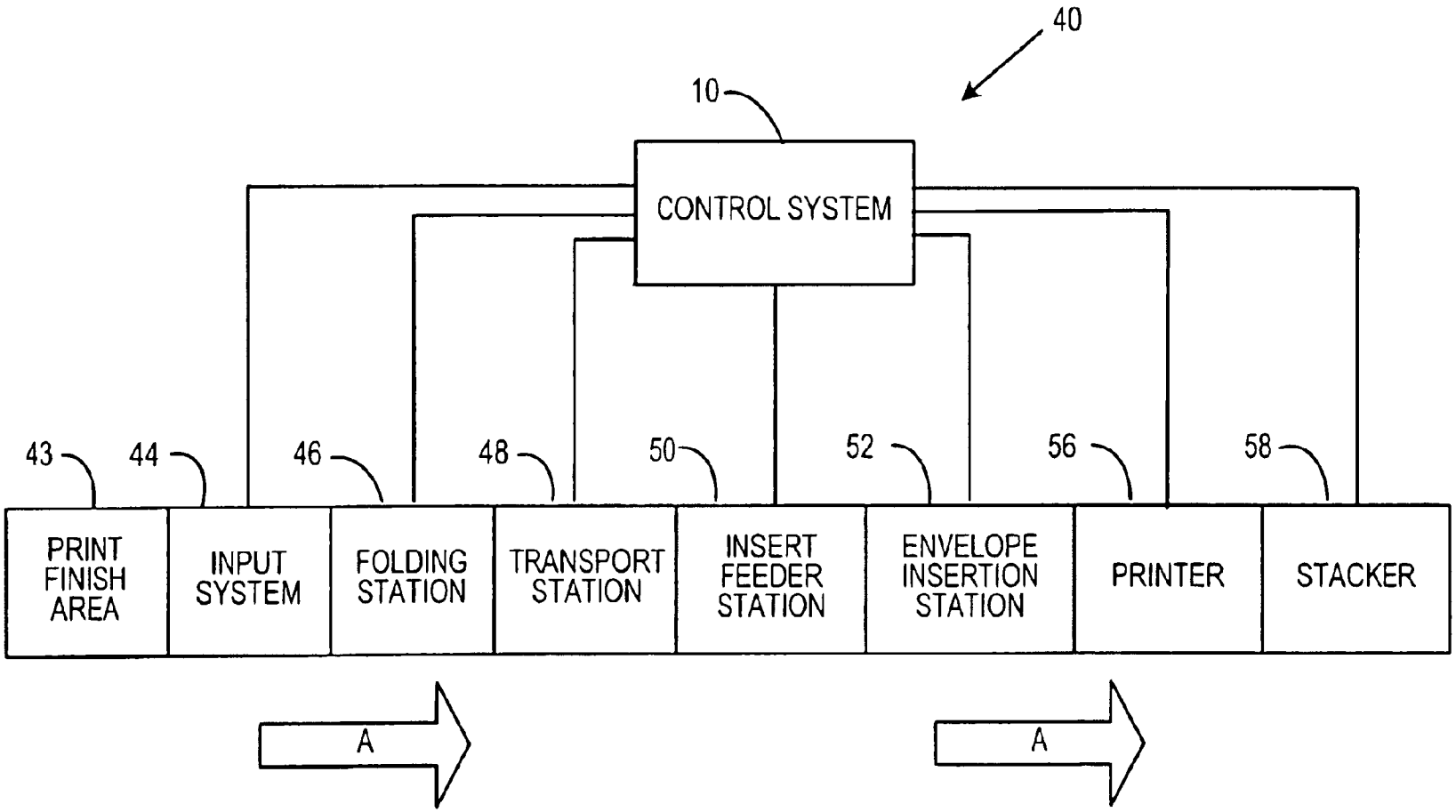
FIG. 2 is a block diagram schematic of a typical document inserter system.

The computer system 10 can be connected to a inserting apparatus as illustrated in FIG. 2. The control system 10 of the inserter system 40 may be the microprocessor-based personal computer system 10 described above. The computer system 10 includes appropriate memory devices 8, 14 for storage of information such as an address database (not shown). One of ordinary skill in the art would be familiar with the general components of the inserter system with which the present invention may be implemented.

Document Inserter System Overview

The stacker apparatus of the present invention may be part of a document inserter system 40. FIG. 2 is a schematic of a typical document inserter system, generally designated 40. In the following description, numerous paper handling stations implemented in inserter system 40 are set forth to provide a thorough understanding of the operating environment of the inserter. However, it will become apparent to one skilled in the art that the present invention may be practiced without the specific details of these paper-handling stations.

As will be described in greater detail below, system 40 preferably includes an input system 44 that feeds paper sheets from a paper web or individual sheets (not shown) to an accumulating station that accumulates the sheets of paper in collation packets (not shown). In this particular example, the apparatus of the present invention provides envelope throat profile information to the control system 10 of inserter system 40 to control the opening of various sized envelopes in the mailing inserter system 40. Alternate methods of inserting include printing the address on the insert document only and inserting such document into a window envelope which reveals the address, printing the documents in a print finishing 43 area upstream from the input system 44 of document inserter system 40 and feeding the documents directly to the input system 40 from the print finishing area 43.

Typically, input system 44 feeds sheets along a paper path, as indicated by arrow A along a deck that is commonly called the main deck (not shown) of inserter system 40. After sheets are accumulated into collations by input system 44, the collations are folded in folding station 46 and the folded collations are then conveyed to a transport station 48, preferably operative to perform buffering operations for maintaining a proper timing scheme for the processing of documents in inserter system 40.

Each sheet collation is fed from transport station 48 to insert feeder station 50. It is to be appreciated that a typical inserter system 40 includes a plurality of feeder stations, but for clarity of illustration only a single insert feeder 50 is shown. Insert feeder station 50 is operational to convey an insert (e.g., an advertisement, business reply envelope or other documents or documentation) from a supply tray to the main deck of inserter system 40 so as to be nested with the aforesaid sheet collation being conveyed along the main deck. The sheet collation, along with the nested insert(s) are next conveyed into an envelope insertion station 52 that is operative to insert the collation into an envelope. The envelope is conveyed to the printer station 56 where appropriate printing such as addressee information and/or postal indicia is applied is applied on an exterior surface of the envelope. Finally, the envelope is conveyed to stacker apparatus 58 that stacks the envelopes in accordance with the present invention.

The use of the document inserter system 40, such as, for example, a Series 9 Inserter Systems manufactured by Pitney Bowes Inc. of Stamford, Conn., is well known. Such document inserter systems are used by organizations (e.g., banking institutions, utility companies, insurance companies, credit companies, and the like) for assembling large amounts of outgoing mailpieces for dispatch through the postal system. Typically, such organizations create documents, such as billing documents, in a computer such as a mainframe computer system (not shown) that is separate from the document inserter system 40 that will process the documents into such mail pieces.

Bottom Stacker

Figure 3:
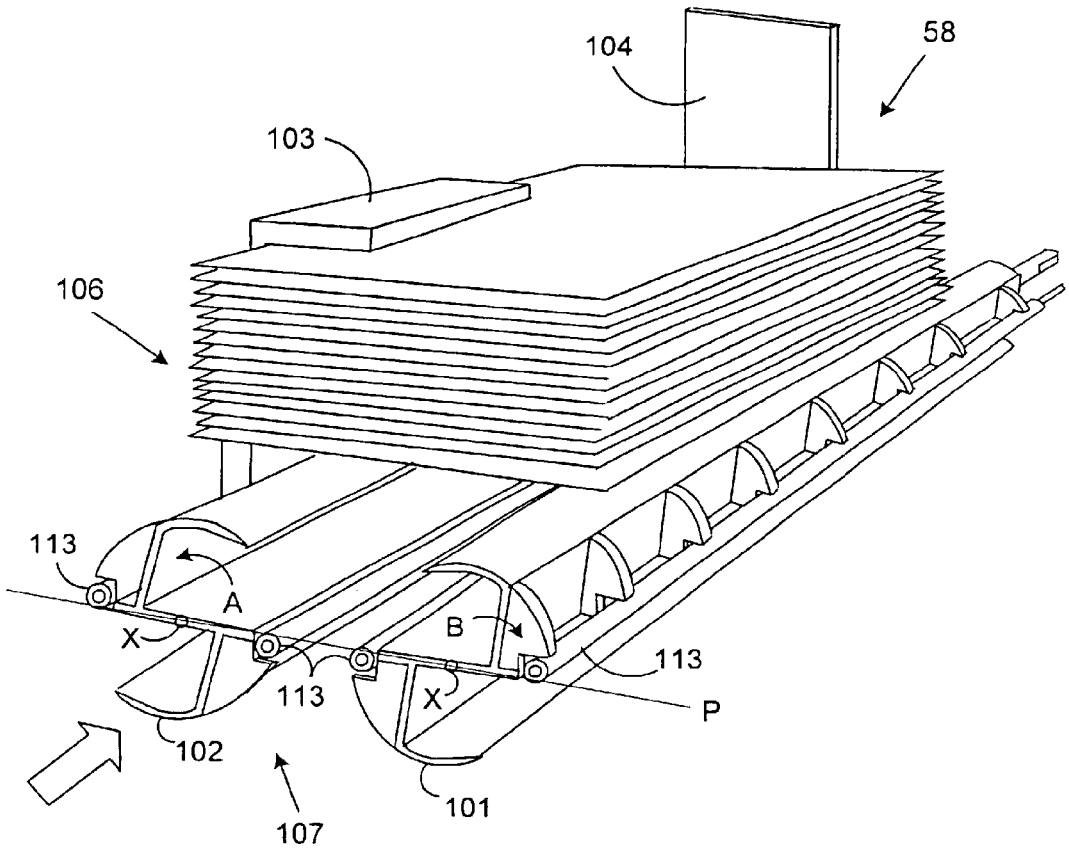
FIG. 3 is a perspective view of an embodiment of the bottom stacking device of the present invention also illustrating adjacent edge guides and insertion of a new mail piece.

FIG. 3 is a perspective view of an embodiment of the bottom stacking apparatus of the present invention also illustrating adjacent edge guides and insertion of a new mail piece.

The embodiment of FIG. 3 is a bottom stacker comprising two intermittently rotating S-elements (or stacker elements) 101, 102, two or more stack guide elements 103, 104 and appropriate drive elements to rotate the rotating S-elements (shown in FIG. 3 and described below). Further, the drive elements include means 105 to move one of the two rotating S-elements 102 into a position consistent with the size of the mailpieces to be stacked while leaving the second rotating S-element 101 fixed.

The first of the rotating S-elements 102 consists of a rigid stacking element which is approximately S-shaped in cross section, adapted to rotate in a counter-clockwise direction shown by arrow A of FIG. 3. The axis of rotation X is at the center of rotating S-element 102. The second rotating S-element 101 is similar to the first rotating S-element 102, however it is mounted in an axially inverted orientation so that it appears in cross-section as a mirror image to rotating S-element 102. The rotating S-elements 101 is approximately S-shaped in cross section, adapted to rotate in a clockwise direction shown by arrow B of FIG. 3. In the axial direction X, both rotating S-elements 101, 102 are preferably longer than the longest mailpiece to be stacked. The axis of rotation for the first and second rotating S-elements is in a common of first plane P illustrated in FIG. 3. In an alternate embodiment, the rotating S-elements 101, 102 could comprise a series of shorter S-shaped elements arranged axially on a common shaft. Each of the rotating S-elements further include rollers 113, which act to reduce friction drag against the bottom of the stack 106. The rotating S-elements 101, 102 operate in concert with each other and each rotating S-element 101, 102 is adapted to rotate 180 degrees and then stop.

FIG. 3 also illustrates the rotating S-elements in a stationary position as new mailpiece 107 is being inserted into the apparatus 58 and between rotating S-elements 101, 102. As will be described in further detail below, the rotating S-elements rotate approximately 180 degrees in order to lift the mailpiece to the bottom of the stack.

Design of the diameters of the rotating S-elements 101, 102 can be accomplished by one of ordinary skill in the art by considering the following factors: 1) Larger diameters require more torque to rotate elements due to higher moment arms and friction drag against the stack; 2) Larger diameters have more inertia, thus more start torque is required; 3) Larger slot opening means lower possibility of contact between the mailpiece and the rigid portions of the S-elements; 4) Larger distance between shelf and bottom of the stack allows the stack to sag between support points on the S-elements without contacting incoming mailpiece; 5) Point at junction of shelf and outer curved surface might hit mailpiece; 6) Being elevated to the stack at a point behind the outside of the flap; 7) Drag of this point across the flap could curl the flap and cause it to be sealed in a non-flat condition; 8) Contact/support point on the left S-element relative to the stack will be the maximum pressure against the flap and adhesive; and 9) Need to understand the optimum location for this support to promote sealing.

Design of the slot opening of the rotating S-elements 101, 102 can be accomplished by one of ordinary skill in the art by considering factors such as the following: 1) the relationship between slot opening and the external point of the shelf is preferably be configured so as to avoid bending the mailpiece by the inside portion of the s-curve; 2) minimize drag on the mailpiece which can cause smearing; 3) the relationship between the slot opening should preferably be configured so that an incoming mailpiece is pushed up into contact with the stack before the curved portion of the rotating S-element slides off the edge of the stack in order to avoid the stack jiggling up and down during stacking (preferably the stack would only move or grow in the upward direction; and 4) configuration of wider slot openings reduces the possibility of image smear as a new mailpiece is sliding onto the shelf.

Design of the location of the left edge of mailpiece from the crotch of the S of the rotating S-elements 101, 102 can be accomplished by one of ordinary skill in the art. The following factors may be considered in the design: 1) vertical registration wall molded into the S-element located away from the crotch should preferably be located to the left of the 12 o'clock position (in the embodiment illustrated) to provide that the stack rests tangentially to the top of the rotating S-element; and 2) the further the registration wall is away from the crotch of the rotating S-element, the less likely the mailpiece will be to drag on the inside wall of the top edge of the slot opening.

Figure 6A:
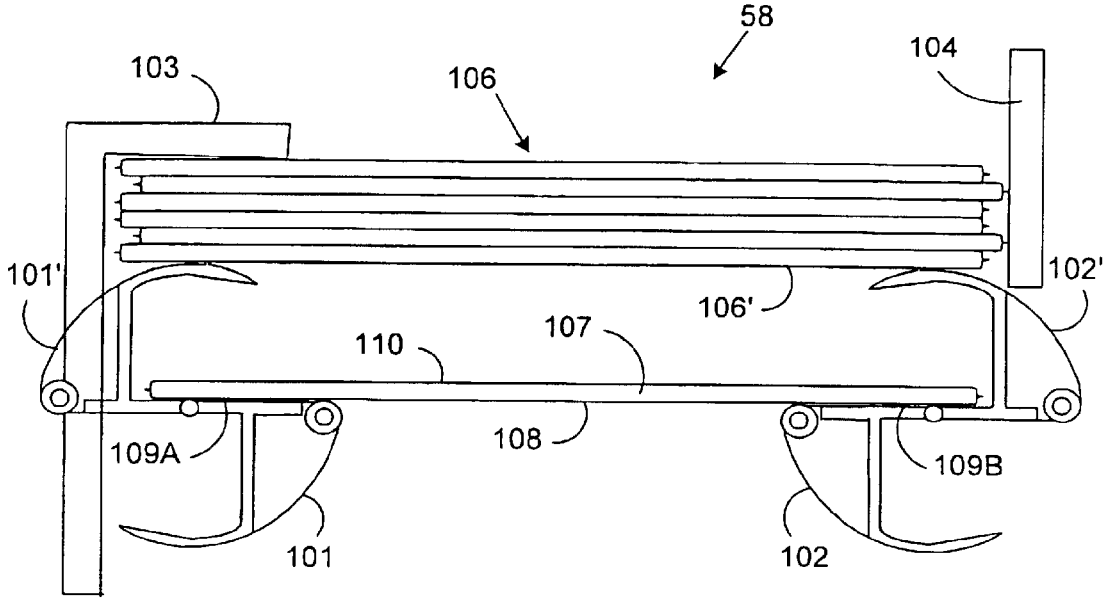
FIG. 6A is a partial side view of an embodiment of the bottom stacking device of the present invention illustrating receipt of a mailpiece onto the S-elements.

The stack of mail pieces 106 rests on top of the rotating S-elements 101, 102. As illustrated in FIG. 6A, a new mail piece 107 to be stacked enters the stacker area at a position below the top curve of the rotating S-elements, and above the center of rotation of the rotating S-elements. Thus, the bottom side 108 of the mailpiece 107 (which typically is not imaged) slides along the portion 109A, 109B of the rotating S-element, which functions as a support shelf for the outer portions or edges of the mailpiece 107. The apparatus is designed so that in optimal operation, the imaged portion (the top side 110 of the mailpiece 107) does not contact either the stack 106 or the upper curved portion 101", 102" of the rotating S-elements 101, 102 while being moved into the stacker 58; therefore, the image portion does not smear.

Figure 6B:
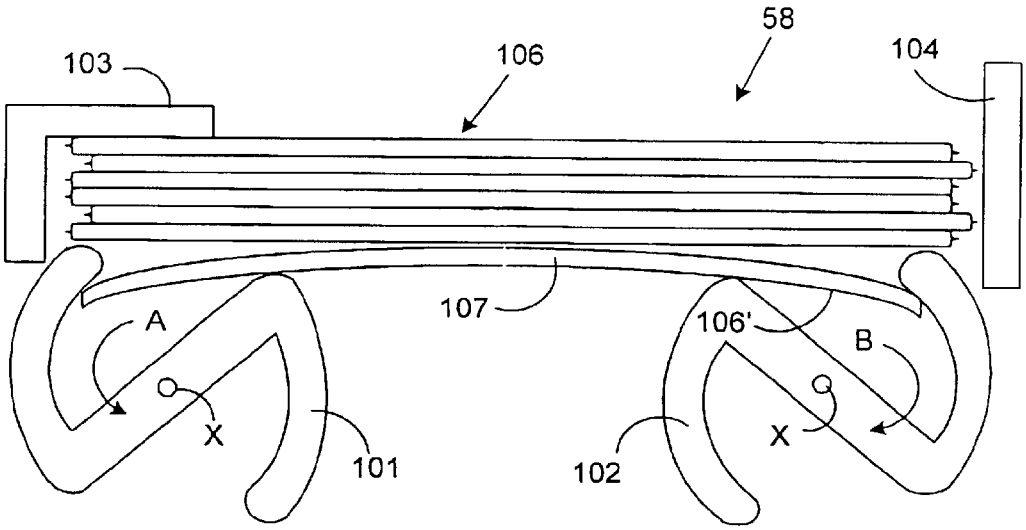
FIG. 6B is a partial side view of an embodiment of the bottom stacking device of the present invention illustrating the S-elements raising the mailpiece to the bottom of the stack while the outer surface of the S-elements support the stack.
Figure 6C:
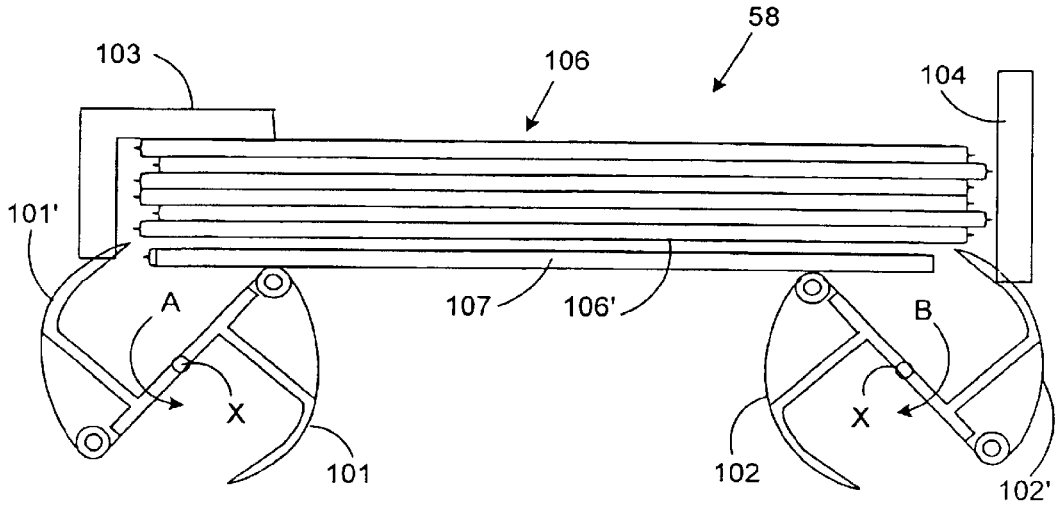
FIG. 6C is a partial side view of an embodiment of the bottom stacking device of the present invention illustrating the S-elements raising the mailpiece to the bottom of the stack while the outer surfaces of the S-elements support the stack until rotating past the edges of the stack followed by the stack slightly falling onto the top of the mailpiece.
Figure 6D:
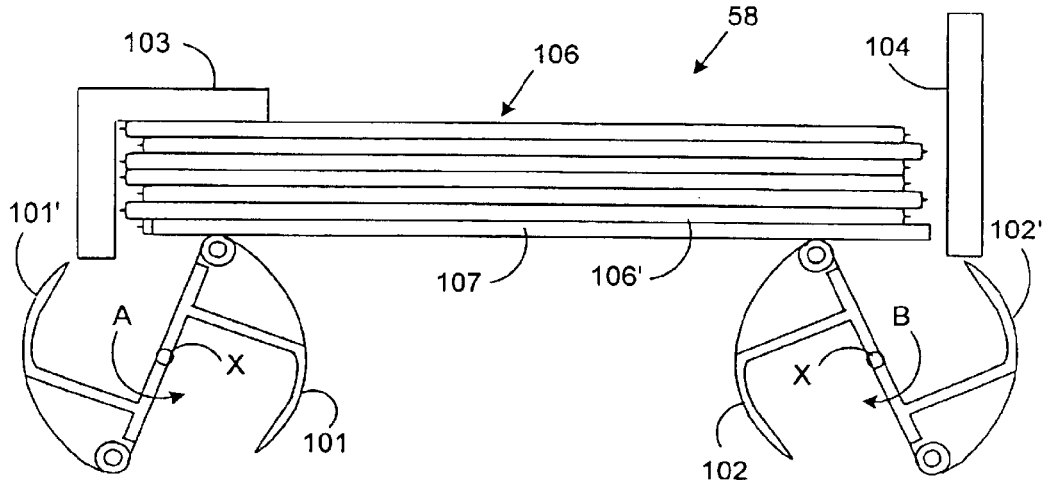
FIG. 6D is a partial side view of an embodiment of the bottom stacking device of the present invention illustrating the mailpiece raised to the bottom of the stack by the S-elements and the S-elements continuing to raise the mailpiece and slightly lifting the stack.

Figure is a partial side view of an embodiment of the bottom stacking device of the present invention illustrating the rotating S-elements 101, 102 raising the mailpiece 107 to the bottom of the stack while the outer surfaces 101 " 102" of the rotating S-elements 101, 102 support the stack until rotating past the edges of the stack 106 followed by the stack 106 slightly falling onto the top 110 of the mailpiece 107. Once the new mailpiece 107 is moved fully into the area below the stack 106 and between the rotating S-elements 101, 102, the rotating S-elements 101, 102 are driven in a 180 degree rotation. The effect of this action is to lift the new mail piece upward and into contact with the bottom of the stack 106" as illustrated in FIG. 6B. Thus, the stack 106 is lifted by the thickness of the new mailpiece 107, as shown in FIG. 6C. FIG. 6C is a partial side view of an embodiment of the bottom stacking device of the present invention illustrating the mailpiece raised to the bottom of the stack by the S-elements and the S-elements continuing to raise the mailpiece and slightly lifting the stack.

Returning to FIG. 3, the two guide elements 103, 104 are oriented approximately perpendicular to each other and extend vertically up from the rotating S-elements in order to support two perpendicular edges of the mailpieces in the stack 106. While the guide elements 103, 104 are shown in a generally vertical orientation, they can be tipped off vertical in two dimensions (not shown) in order to keep the stack 106 of mailpieces corner registered. Guide element 103 can also be configured with a ledge portion 112 (shown in FIG. 4) that rests on top of the top mailpiece in the stack 106 in order to provide pressure on the stack 106 to aid in sealing the top mailpiece 106"" in the stacker apparatus 58. Guide 103 is further configured to slide in a generally vertical direction, as shown by arrow V in FIG. 4, so that the guide 103 continues to ride on top of the stack 106 as additional mailpieces are added to the stack. The resting of the guide on the stack assists in sealing the mailpieces positioned toward the top of the stack.

Figure 4:
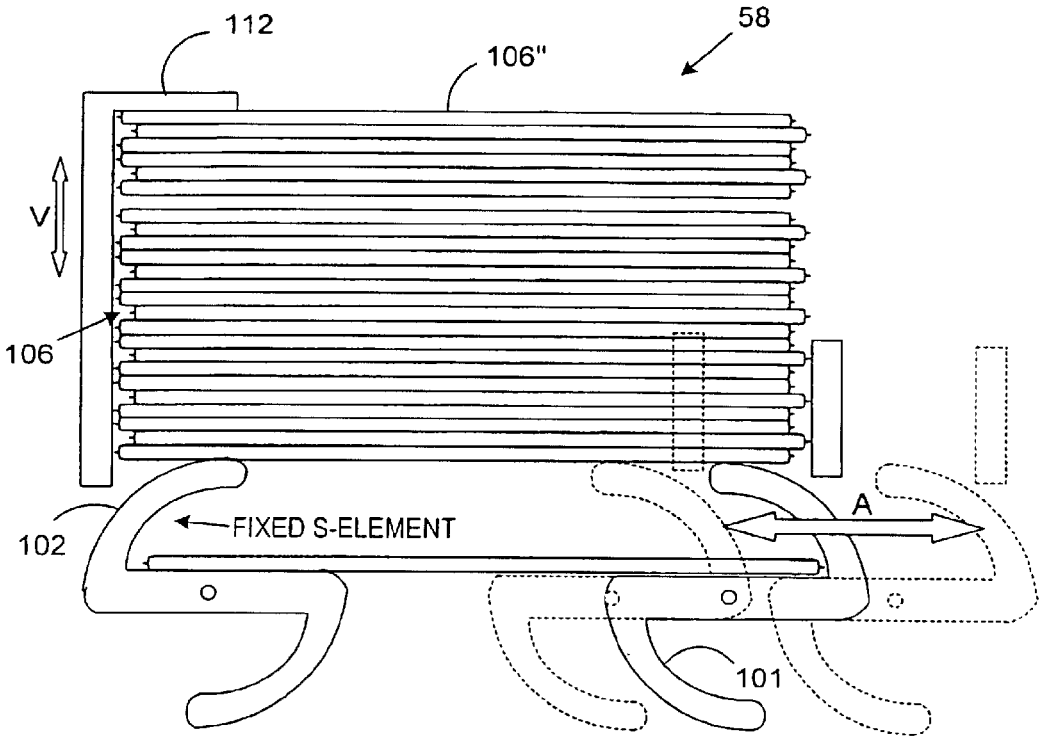
FIG. 4 is a side view of an embodiment of the bottom stacking device of the present invention illustrating edge guides, a fixed S-element and a movable S-element.
Figure 5:
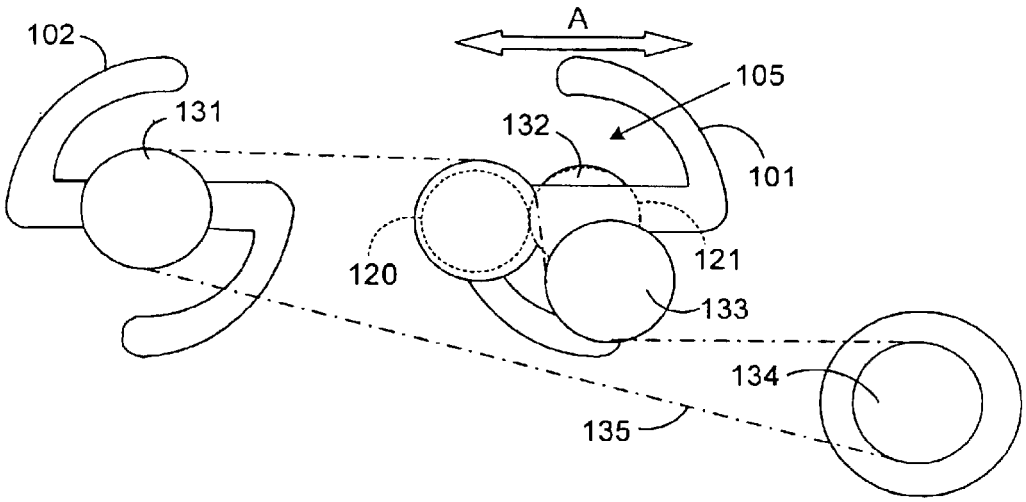
FIG. 5 is a partial side view of the S-elements of an embodiment of the present invention and a simplified view of a an embodiment of the drive configuration for moving the S-elements.

FIG. 4 illustrate rotating S-elements 101, 102 and FIG. 5 illustrates an embodiment of a drive configuration for the rotating S-elements. FIG. 5 further illustrates assembly 105 comprising first and second rotating S-elements 101, 102, a gear set comprising first and second gears 120, 121, timing belt or first, second and third pulleys 131, 132, 133, a motor/drive pulley 134 and a timing belt 135. Rotating S-element 102 and drive pulley 131 remain in a fixed position for edge registered mailpieces. Rotating S-element 101 is slidably mounted so that it can slide from, for example in the orientation shown in FIG. 4, left to right and back (as illustrated by arrow A of FIGS. 4 and 5). Assembly 105 can detent into position to accommodate various mailpiece widths.

In the preferred embodiment, the present invention is a bottom stacking system that arrays the stack of mailpieces in a vertical orientation. Further, the bottom stacker reduces sliding contact with other mailpieces or portions of the stacker mechanism for portions of the mailpiece that have been recently imaged. This present invention decreases eliminates smearing of images, it reduces the footprint substantially, causes recently stacked mailpieces to feel the weight of the stack to improve the sealing, stacks in 1 to N order, and it enables simple unload while running and the capability of running with minimal operator skill. It also decreases the need to shut down the system in the middle of a job in order to unload the device.

In an alternate embodiment, the purpose of the means for moving the second stacking element is to rotate it in sync with the first S-element regardless of the linear position.

The embodiments described herein can provide the advantages by decreasing the need for operator adjustment of mail handling equipment. While the present invention has been disclosed and described with reference to a various embodiments thereof, it will be apparent, as noted above that variations and modifications may be made therein. It is, thus, intended in the following claims to cover each variation and modification that falls within the true spirit and scope of the present invention.

What is claimed is:

1. An apparatus for stacking material pieces in a vertical stack, the apparatus comprising:

a first stacking element approximately S-shaped in cross section, adapted to rotate in a counter-clockwise direction having an axis of rotation at about the center of the first stacking element and positioned in a first plane;

a second stacking element approximately S-shaped in cross section, adapted to rotate in a clockwise direction having an axis of rotation at about the center of the second stacking element and positioned in the first plane at a predetermined distance from the axis of rotation of the first stacking element, the second stacking element having an axially inverted orientation with respect to the first stacking element;

the first stacking element comprising a first shelf extending about perpendicularly from the axis of rotation of the first stacking element;

the second stacking element comprising a second shelf extending about perpendicularly from the axis of rotation of the second stacking element;

whereby the first and second shelves provide support for outer portions of a material piece that is to be added to the bottom of the stack;

whereby the stacking elements operate in concert with each other by rotating and lifting the material piece to the bottom of the stack, and wherein the second stacking element is configured to move linearly in the first plane such that linear movement causes the distance between the first stacking element and the second stacking element to increase or decrease depending upon the direction of movement and whereby the linear movement allows the stacker to accommodate material pieces of various widths.

2. The apparatus as claimed in claim 1 further comprising a guide element positioned adjacent to the first stacking element, the guide element configured to assist with edge alignment of material pieces in the stack.

3. The apparatus as claimed in claim 2 further comprising a second guide element for assisting with edge alignment of the material pieces.

4. The apparatus as claimed in claim 1 wherein the first stacking element is in a fixed position in the first plane.

5. The apparatus as claimed in claim 1 further comprising a means for moving the second stacking element linearly along the first plane.

6. The apparatus as claimed in claim 5 wherein the means for moving the second stacking element linearly along the first plane comprises a timing belt, a first idler pulley coupled to the first stacking element and moved by the timing belt, an adjustable gear set, the first gear coupled to the second stacking element and a second idler pulley and moved by the timing belt, a third idler pulley positioned adjacent to the adjustable gear set and moved by the timing belt, and a drive pulley for driving the timing belt, whereby when the drive pulley moves the timing belt the second stacking element moves along the first plane.

7. The apparatus as claimed in claim 1 whereby the first stacking element rotates approximately 180 degrees in the counter clockwise direction and the second stacking element rotates approximately 180 degrees in the clockwise direction to lift the material piece to the bottom of the stack.

8. The apparatus as claimed in claim 1 whereby the first stacking element rotates approximately 360 degrees in the counter clockwise direction and the second stacking element rotates approximately 360 degrees in the clockwise direction to lift the material piece to the bottom of the stack.

* * * * *